US006347668B1

(12) United States Patent
McNeill

(10) Patent No.: US 6,347,668 B1
(45) Date of Patent: Feb. 19, 2002

(54) RELIEVABLE CHECK VALVE ASSEMBLY FOR OIL WELLS AND WATER WELLS

(76) Inventor: John L. McNeill, 105 Lariat La., Victoria, TX (US) 77901

( * ) Notice: Subject to any disclaimer, the term of this patent is extended or adjusted under 35 U.S.C. 154(b) by 0 days.

(21) Appl. No.: 09/556,677

(22) Filed: Apr. 21, 2000

(51) Int. Cl.[7] ..... E21B 34/14

(52) U.S. Cl. ..... 166/332.4; 166/332.7; 166/334.3; 166/105; 166/108; 417/444; 417/445; 417/555.2

(58) Field of Search ..... 166/332.4, 332.6, 166/332.7, 334.3, 105, 105.3, 108, 111; 417/552, 555.1, 555.2, 443, 444, 445

(56) References Cited

U.S. PATENT DOCUMENTS

| | | | | |
|---|---|---|---|---|
| 1,314,070 A | | 8/1919 | McKissick | |
| 1,543,179 A | | 6/1925 | Miller et al. | |
| 1,660,486 A | | 2/1928 | Friend | |
| 3,941,516 A | * | 3/1976 | Soberg | 417/259 |
| 3,995,691 A | | 12/1976 | Hedgecock et al. | |
| 4,637,471 A | | 1/1987 | Soderberg | |
| 4,645,007 A | | 2/1987 | Soderberg | |
| 4,782,895 A | | 11/1988 | Jacob et al. | |
| 4,856,756 A | | 8/1989 | Combs | |
| 5,141,411 A | * | 8/1992 | Klaeger | 417/445 |
| 5,249,936 A | * | 10/1993 | McConnell et al. | 417/444 |
| 5,310,005 A | | 5/1994 | Dollison | |
| 5,425,416 A | | 6/1995 | Hammeke et al. | |

FOREIGN PATENT DOCUMENTS

| | | |
|---|---|---|
| SU | 1388-548 A1 | 4/1988 |
| SU | 1434-082 A1 | 10/1988 |

* cited by examiner

*Primary Examiner*—David Bagnell
*Assistant Examiner*—Zakiya Walker
(74) *Attorney, Agent, or Firm*—Richard C. Litman

(57) ABSTRACT

A relievable check valve assembly having various trigger forms for oil wells and water wells adapted to control the liquid flow when inserted tubing is being removed from a well.

4 Claims, 8 Drawing Sheets

80

RELIEVABLE CHECK VALVE ASSEMBLY FOR OIL WELLS AND WATER WELLS

BACKGROUND OF THE INVENTION

1. Field of the Invention

The present invention relates generally to valves. More specifically, the invention is a relievable check valve assembly for oil or water wells comprising a check valve with a pin, a guide and triggers of various shapes.

2. Description of the Related Art

The relevant art of interest describes various check valve assemblies, but none discloses the present invention. There is a need for an efficient and inexpensive check valve for use in wells in order to drain fluid out of a plunger type pump and a string of tubing prior to pulling them out of a well. Removing the fluid, water or oil, and entrained debris from inside the tubing will greatly reduce the weight of the string of tubing and thus make the whole operation easier and safer. The relevant art will be discussed in the order of perceived relevance to the present invention.

U.S. Pat. No. 1,543,179 issued on Jun. 23, 1925, to Andrew Miller et al. describes a valve trip mechanism for bleeding the tubing of a deep well while the tubing is being extracted. When the working barrel is pulled toward the surface, an edge of the barrel contacts the head of a rod which shifts a lever. The lever operates a lift rod which pushes a ball valve out of its seat within the working barrel and allow fluid within the tubing to drain back into the ground and lessen the weight of the tubing being pulled out. The valve trip mechanism is distinguishable for utilizing a ball valve motivated by a pivoting lift rod consisting of three segments and a spring.

U.S. Pat. No. 1,314,070 issued on Aug. 26, 1919, to William H. McKissick describes a drainage valve for deep well pumps comprising a first embodiment of FIGS. 1 and 2 drawn to two spaced collars on bowed springs which cause the opening of a ball valve in a thick coupling by pushing down a perforated sleeve against the ball and its compression spring. The second embodiment of FIGS. 3 and 4 entails a standing ball valve resting on an apertured coupling in contact with a sliding double collared and outwardly bowed springs element and having an internal T-shaped bolt with extending arms. The arms immobilize the upper collar member having L-shaped arms by twisting prior to removal to cause the shaft of the T-shaped bolt to push up the ball and open the drain pipe. The drainage valves are distinguishable for requiring ball valves.

U.S. Pat. No. 4,856,756 issued on Aug. 15, 1989, to Linsey L. Combs describes a well bottom release valve assembly comprising a well bottom release valve axially aligned just above a down hole pipe. A short pipe section with a spring biased tight fitting sleeve is manually controlled from the surface by a cable to open drainage ports in the sleeve that allow the water contained within to drain out of the tubing above the down hole pump. The valve assembly is distinguishable for its above ground manual cable control element.

U.S. Pat. No. 1,660,486 issued on Feb. 28, 1928, to John A. Friend describes a drain valve for an inner tube of deep well pumps for drainage during removal of the inner tube from the well casing. A casing integrated with the tubing contains an elaborate mechanism which causes the opening of a drainage hole by movement of a plunger attached to a lever (and leaf spring) having a projection which catches in the space between two casings connected by a coupling. A cam lug of the lever pushes down the plunger against a ball valve under spring compression away from its seat. The drain valve mechanism is distinguishable for its numerous parts involving a lever, a plunger, a ball valve, and a lever.

U.S. Pat. No. 3,995,691 issued on Dec. 7, 1976, to Floyd R. Hedgecock et al. describes a tool for draining fluids in an oil well while removing a well conduit. An enclosure of an apertured tubular housing connected to a well conduit by two couplings permits drainage from the second bottom coupling when the pushrod attached to the fluid pump is uplifted. The tool is distinguishable for its apertured housing and couplings.

U.S. Pat. No. 4,637,471 issued on Jan. 20, 1987, to Paul B. Soderberg describes a tubing drain valve device useful with heavy sand-bearing oil and its method of use in a borehole. A first tubular member of a sub is connected to a pipe string in a casing with three dogs which engage the casing. A second tubular member surrounds an upper portion of the first tubular member and is attached by three shear pins and supported by a compression spring. As the pipe string is pulled up, the dogs contact the casing wall and cause the spring to compress for approximately three feet before the shear pins break and open slots for drainage of the fluid in the pipe string. The tubing drain valve device is distinguishable for its required dogs and shear pins.

U.S. Pat. No. 4,645,007 issued on Feb. 24, 1987, to Paul B. Soderberg describes a sub including a tubing drain valve and its method of use in a borehole. The sub comprising a tubular member is inserted in a pipe string by an upper connector and a lower connector and includes a tubular piston connected to a sucker rod. The tubular member has a C-spring with six bosses contacting the tubular member. Three dogs located inside the tubular member are positioned for contacting two semi-circular members on a lowermost position of the sucker rod to hold the uplifted pipe string in place to allow the fluid to drain through aligned ports in the tubular piston and the tubular member. The sub and tubing drain valve are distinguishable for requiring a C-spring with bosses, semi-circular holding members, a hollow piston, and dogs.

U.S. Pat. No. 4,782,895 issued on Nov. 8, 1988, to Jean-Luc Jacob et al. describes a pumped oil well bottom safety valve automatically closing when pumping stops and reopening when pumping resumes. A cylindrical valve body attached at the end of a production tube and below the valve pump has two cylindrical vertical channels. The first channel has a valve seat closed by a flap controlled by a lever and an orifice below the flap. The second channel is plugged on the bottom and the top with the top plug abutting a return spring. A push rod attached to the spring has a transverse second pressure valve and a notch for actuating the lever and flap. The bottom end of the push rod moves a piston closing an admission chamber having an orifice. The valve body is distinguishable for its numerous parts of a two-channelled body.

U.S. Pat. No. 5,310,005 issued on May 10, 1994, to William W. Dollison describes a flapper valve assembly with a floating hinge located between two pipe sections and used in oil and gas wells. A semicircular flapper body is supported by two pivoting struts and blocks a flow sleeve or can be folded behind the flow sleeve. The flapper valve assembly is distinguishable for its flapper and strut structure.

U.S. Pat. No. 5,425,416 issued on Jun. 20, 1995, to Michael N. Hammeke et al. describes a formation injection tool for down-bore in-situ disposal of undesired fluids. The oil and natural gas are expelled upwards in the upstroke of the pump and the mineral laden water is disposed underground in the lower disposal formations during the down stroke. The injection tool consists of three basic parts comprising an upper intake flow assembly, a middle seal mechanism and a lower discharge control device. The formation injection tool is distinguishable for its extensive structure.

Soviet Union Patent Application No. SU 1388-548 A published on Apr. 4, 1988, for Volg Oil Ind. describes an oil well expeller by using strata energy to drive a pump with its cylinder connected to an underground separator. The separator has two chambers with a piston and a poppet valve on a rod in the upper chamber and a compression spring and stop in a perforated lower chamber. Increasing pressure in upper chamber by the rising crude causes the piston to rise to close the poppet valve by the pressure difference. The crude enters the well tubing and up to decrease the pressure in the separator to move the piston down to expel the water through the perforations into the absorbing underground level. The device is distinguishable for its two fluid separating sections, piston and poppet valve structure.

Soviet Union Patent Application No. SU 1434-082 A published on Oct. 30, 1988, for Bashkir Oil Ind. describes a production well pump-out equipment with a drain valve comprising a cylinder having a seat for a ball and a piston under it with a rod interacting with the ball when the pump stops operation. The drain valve is distinguishable for its piston structure.

None of the above inventions and patents, taken either singularly or in combination, is seen to describe the instant invention as claimed. Thus, a relievable check valve assembly for oil wells and water wells solving the aforementioned problems is desired.

SUMMARY OF THE INVENTION

A relievable check valve assembly for oil or water wells is shown comprising a check valve with a pin, a guide and triggers of various shapes. There is a need for a check valve for controlling the liquid discharge from wells when removing the tubing.

Accordingly, it is a principal object of the invention to provide a check valve assembly for oil and water wells.

It is another object of the invention to provide a check valve assembly for oil and water wells when removing the in-ground tubing.

It is a further object of the invention to provide a check valve assembly for oil and water wells when removing the in-ground tubing for draining the liquid and entrained solids from the tubing back into the well.

Still another object of the invention is to provide a check valve assembly for oil and water wells when removing the in-ground tubing comprising a pin, a guide and a trigger.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
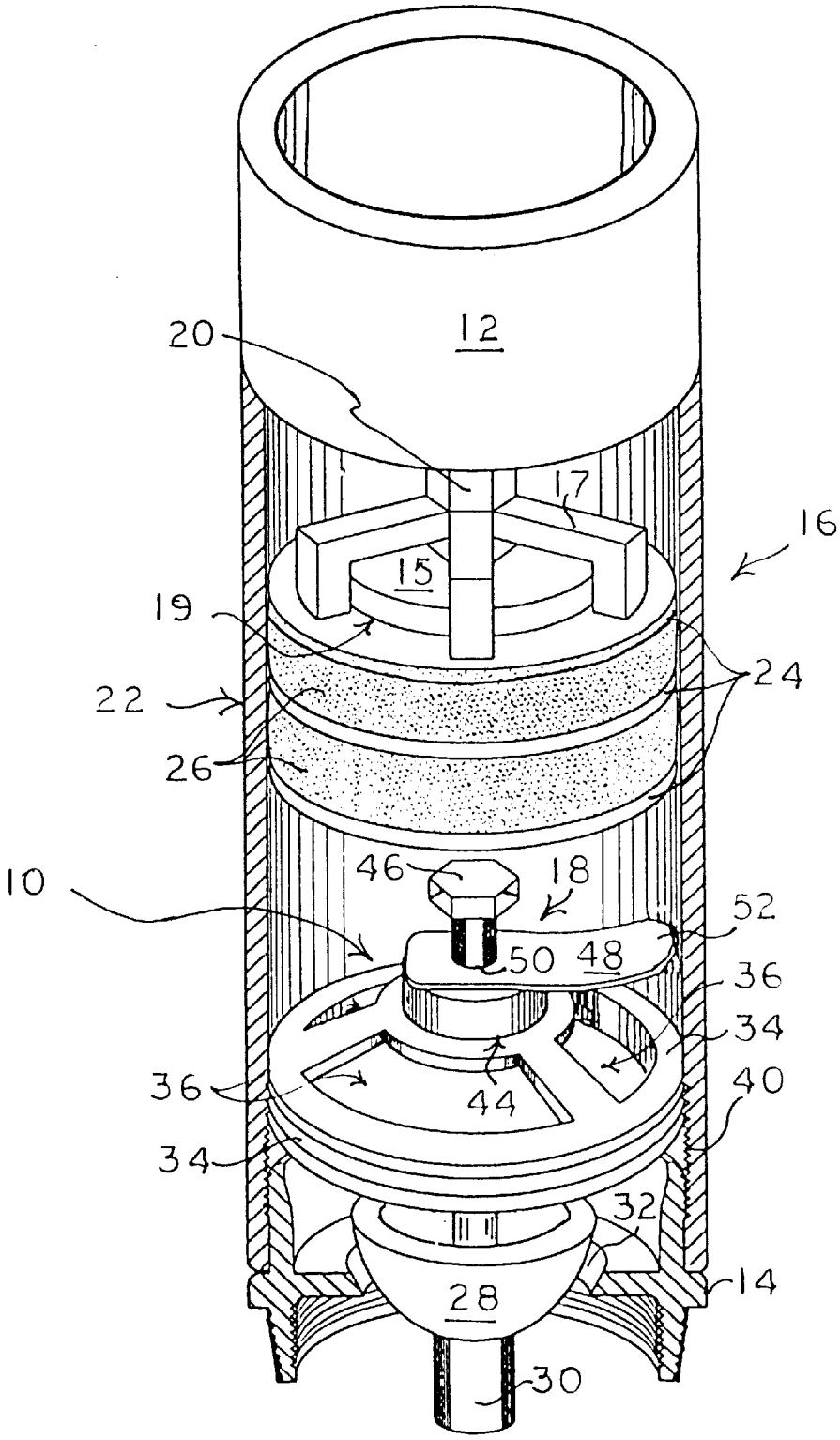
FIG. 1 is an elevational cutaway view of a first embodiment for a relievable check valve assembly for oil or water wells according to the present invention.
Figure 2:
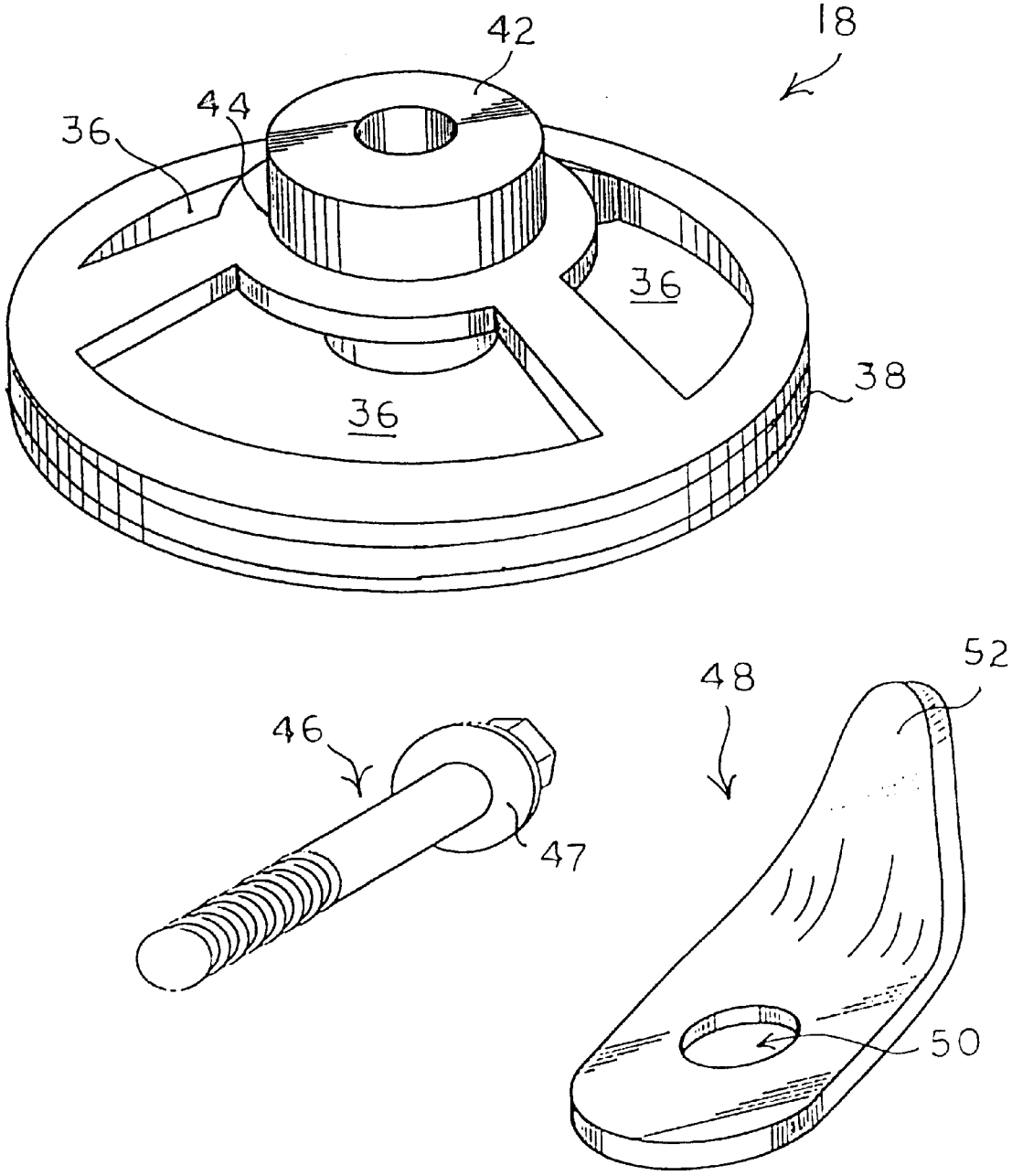
FIG. 2 is a perspective view of the first embodiment showing a guide inserted in a plate, a pin and a trigger with a conventional valve.

The present invention is directed to valves useful in oil or water wells for draining the fluids when removing well tubing from a down hole. FIGS. 1, 2, 3A, 3B, and 3C illustrate a first embodiment of a check valve assembly 10. In FIG. 1, a portion of an upper well tubing member 12 threadingly joined to a lower valve assembly casing member 14 are broken away to expose a conventional traveling valve unit 16 with its valve member 15 and cage 17, and a modified standing valve unit 18. A push rod 20 shown in an upstroke or open position is attached to a plunger 22 comprising steel discs 24 with two enclosed neoprene discs 26. The first embodiment of the check valve assembly 10 in a closed position comprises a bell-shaped valve member 28 with an internally threaded stem 30. The valve member 28 is configured to abut the valve seat 32 formed inside the valve assembly casing member 14. An apertured planar steel disc 34 with three apertures 36 has a threaded edge 38 which is engaged by the internal threading 40 at the end of the well tubing 12. A Teflon bushing 42 is positioned to seat on top of the disc 34 and its narrow portion to extend slightly below the disc through the central throughbore 44 in the disc. A flat headed bolt or guide pin 46 with a washer 47 secures a steel trigger 48 configured with a throughbore 50 and an upturned end 52 to the bushing 42, the disc 34, and the valve member 28.

Figure 3C:
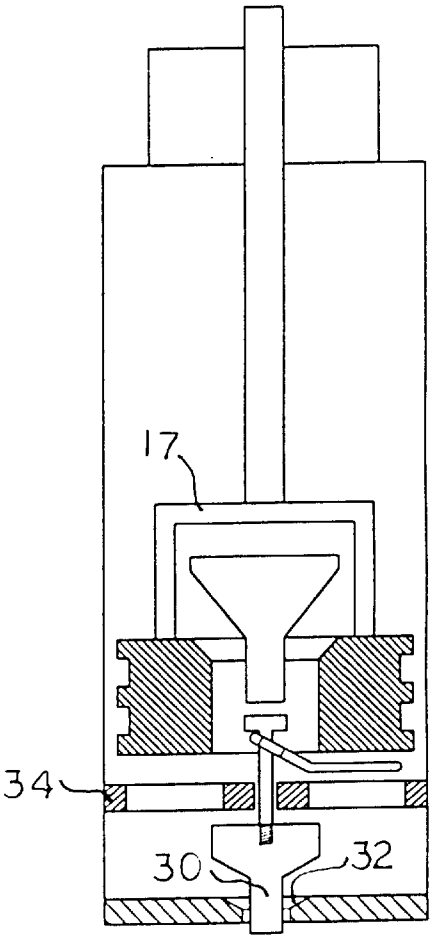
FIGS. 3A, 3B and 3C are schematic diagrams of the first embodiment showing the sequence of the valve operation.
Figure 3B:
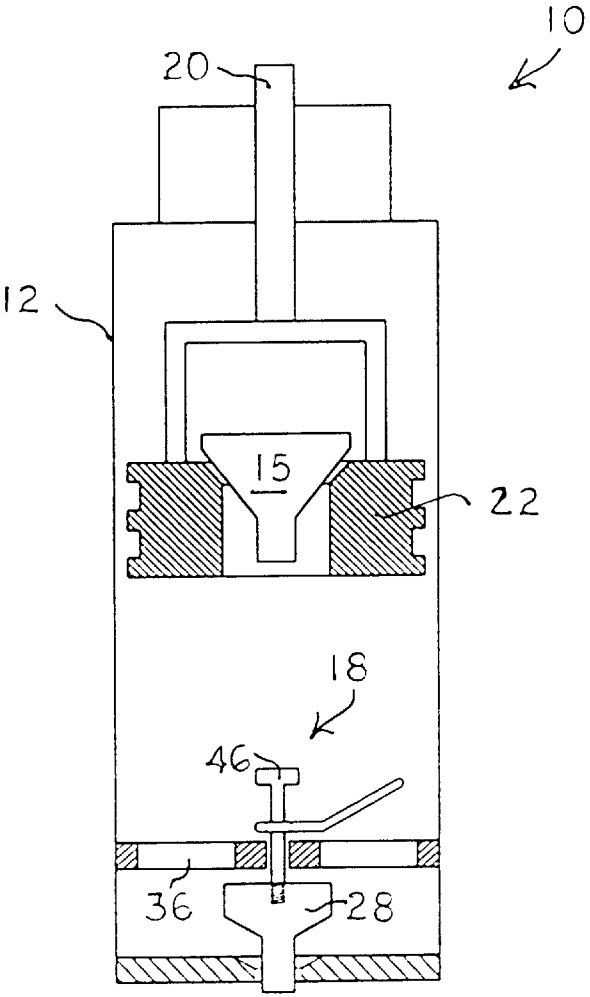
Figure 3A:
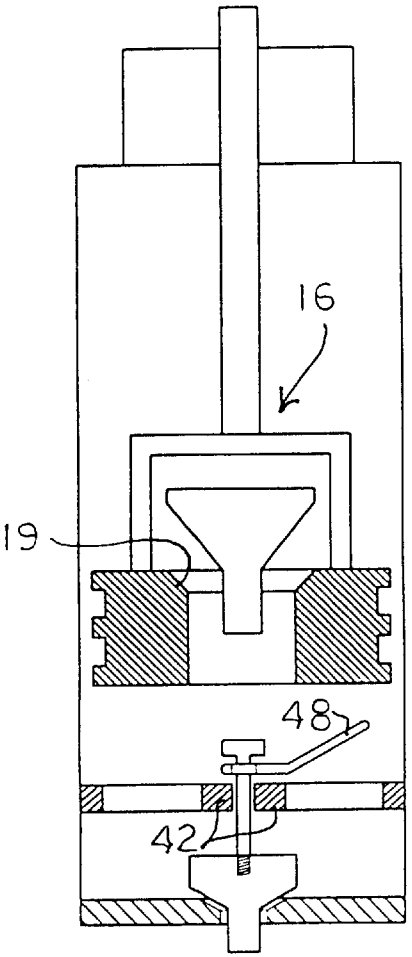

Turning to the diagrammatic partially sectional views of FIGS. 3A, 3B and 3C, wherein FIG. 3A depicts the stage when the push rod 20 initially begins a downstroke with the traveling valve unit 16 with its valve member 15 being uplifted from its valve seat 19 by hydrostatic pressure. The valve member 28 in the standing valve unit 18 is seated on the valve seat 32 and the trigger 48 has its upturned end 52 facing up. The fluid trapped in the region between the two valve units is forced through the open traveling valve unit 16 into the upper region. It should be noted that the relievable check valve assembly 10 is unaffected by this operation.

FIG. 3B depicts the normal operation of a standard reciprocating plunger type pump on the downstroke of the traveling valve unit 16. The upstroke motion causes the upper valve member 15 of the traveling valve unit 16 to close and the lower valve member 28 to open temporarily through hydrostatic pressure to force the fluid below the standing valve unit 18 to be pumped up into the tubing. Again, the relievable check valve assembly 10 is unaffected by this operation.

FIG. 3C illustrates the operation of the relievable check valve assembly 10 when the well operator desires to pull up the string of tubing or to clear trash out of the standing valve unit 18. The well operator disconnects the rod string and sets it down on the bottom of the pump. This action causes the traveling valve member 15 to strike the guide pin 46 to raise the trigger 48 of the relievable check valve assembly 10 and the standing valve member 28, and simultaneously raise the traveling valve member 15 to cause the entrained well fluid to drain from the tubing back into the well.

Figure 4:
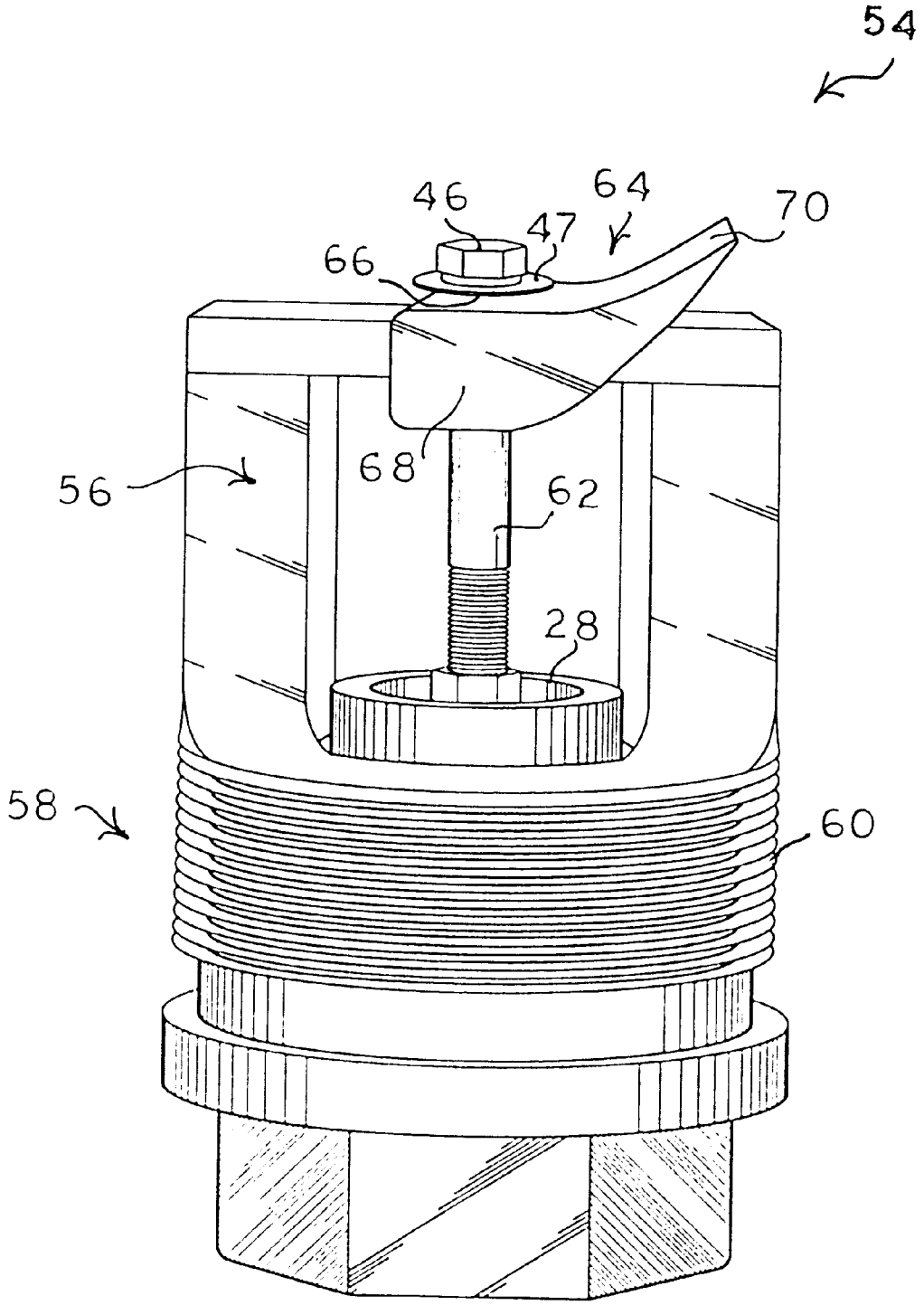
FIG. 4 is perspective view of a second embodiment of a valve assembly having a trigger with an enlarged base.

FIG. 4 illustrates a second embodiment for a modification of a check valve assembly 54 comprising an inverted U-shaped frame portion 56 on a body portion 58 having external threading 60 for securing to an end of the well tubing 12. The frame portion 56 has a throughbore (hidden) to support a guide pin 62 and a trigger 64 configured with a U-shaped cross-section, an aperture 66, a wide flanged base portion 68 straddling the frame portion 56, and tapering to a raised tip 70. The head 46 of the guide pin 62 is seated with a washer 47 on the trigger 64. The trigger is connected by the guide pin 62 to the bell-shaped standing valve member 28 seated on a valve seat (hidden) in the lower region of the body portion 58.

Figure 5C:
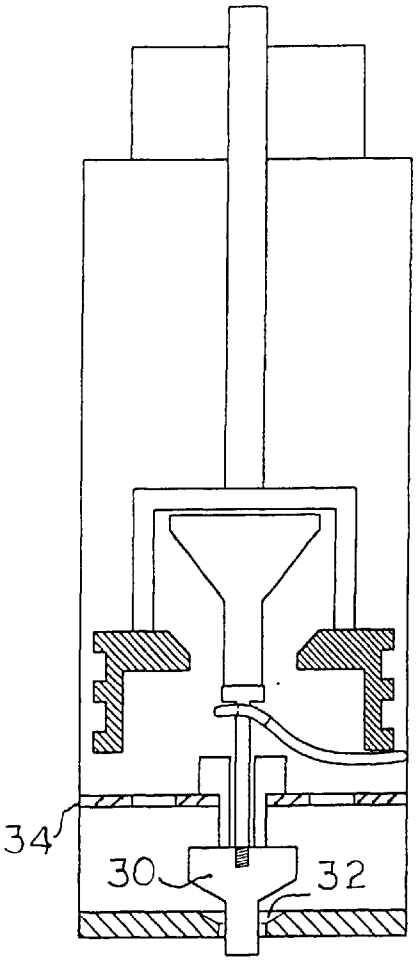
FIGS. 5A, 5B and 5C are schematic diagrams of a third embodiment showing the sequence of the valve operation.
Figure 5B:
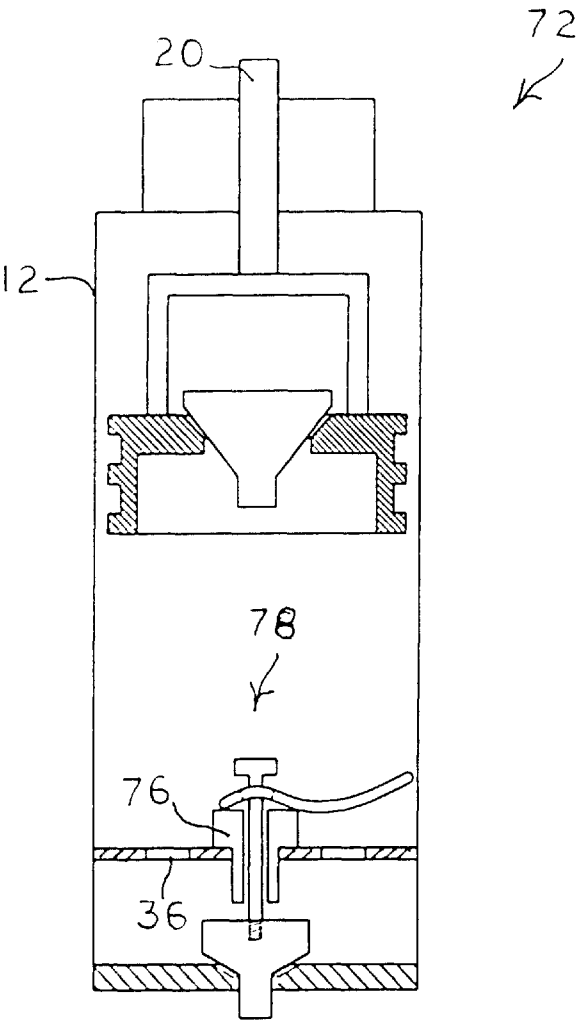
Figure 5A:
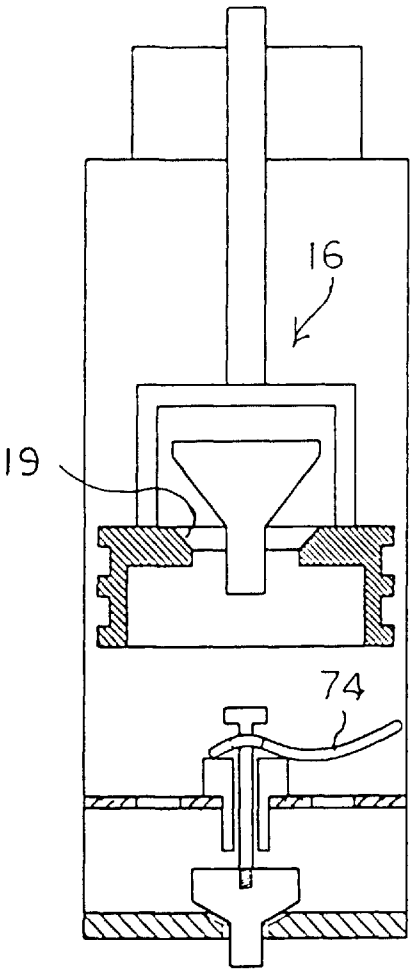

FIGS. 5A, 5B and 5C illustrate a third embodiment 72 utilizing a double curved trigger 74 standing on a raised Teflon bushing 76 in the third standing valve unit 78 in a sequence described above for the second embodiment of FIGS. 3A to 3C.

Figure 6C:
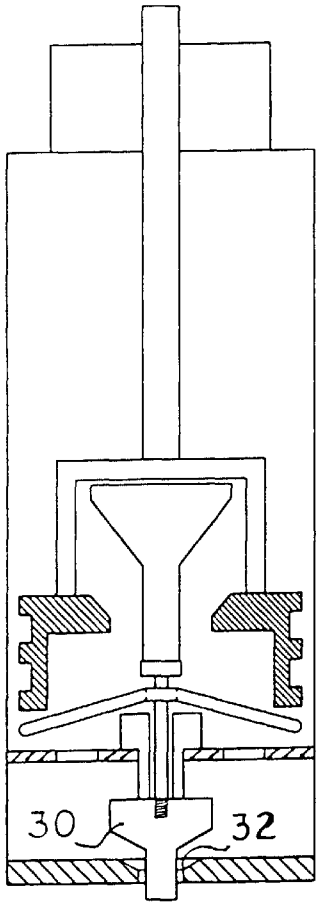
FIGS. 6A, 6B, 6C, 6D and 6E are schematic diagrams of a fourth embodiment showing the sequence of the valve operation.
Figure 6B:
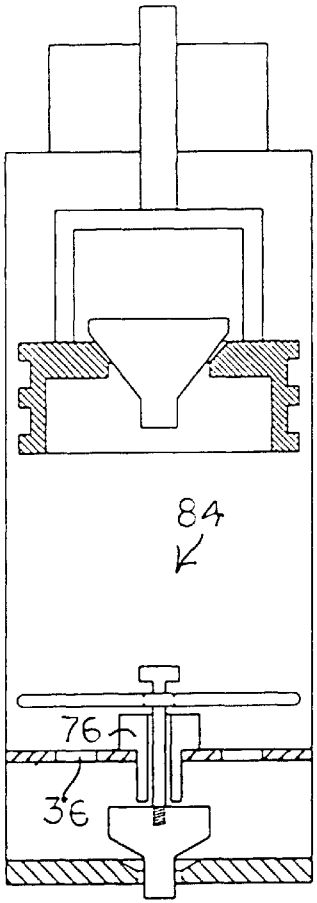
Figure 6A:
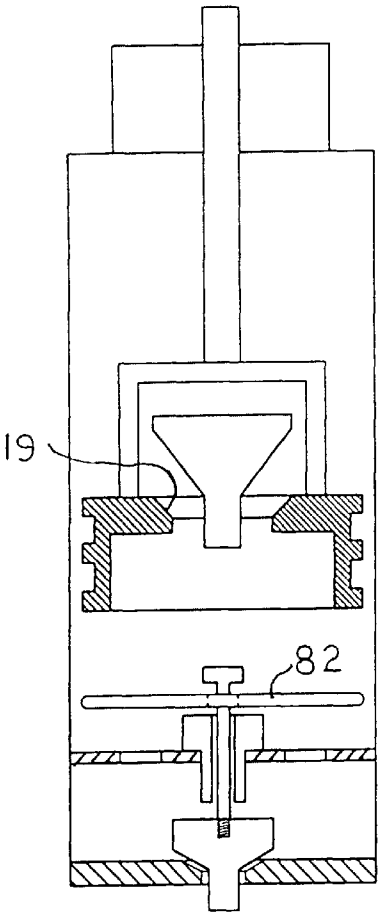
Figure 6D:
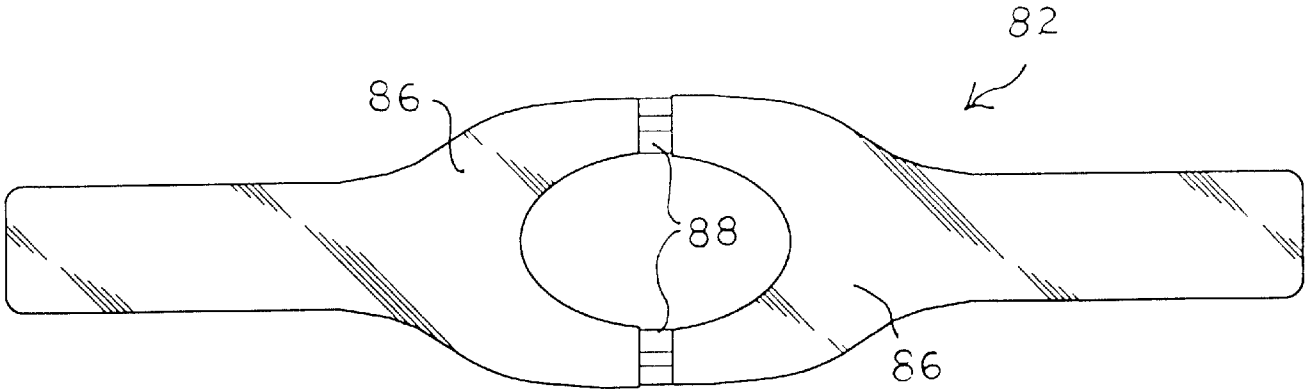
Figure 6E:
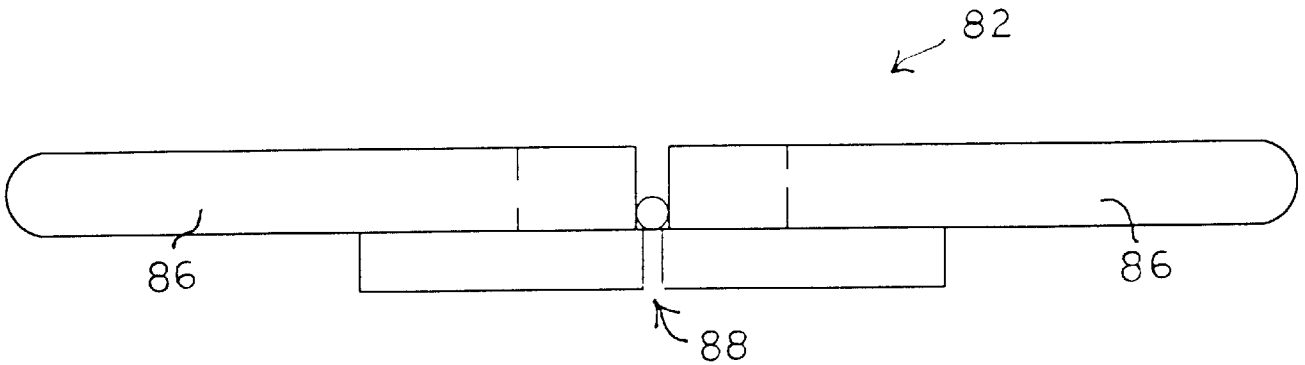

FIGS. 6A, 6B and 6C illustrate a fourth embodiment 80 utilizing a hinged trigger 82 in the fourth standing valve unit 84 in a similar sequence. FIGS. 6D and 6E depict the hinged trigger 82 having two Y-shaped elements 86 joined by a hinge 88.

Figure 7C:
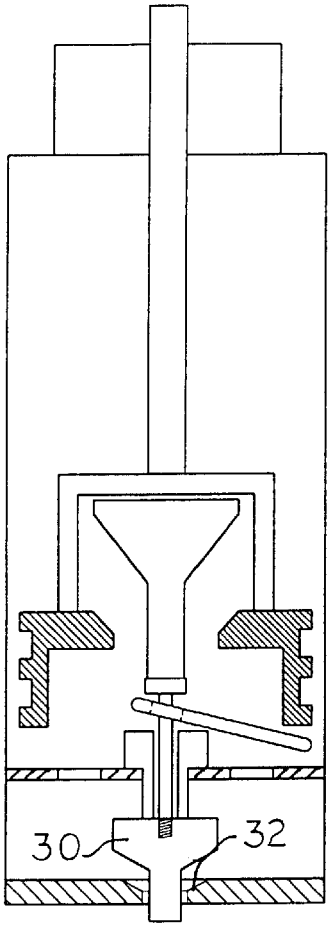
FIGS. 7A, 7B and 7C are schematic diagrams of a fifth embodiment showing the sequence of the valve operation.
Figure 7B:
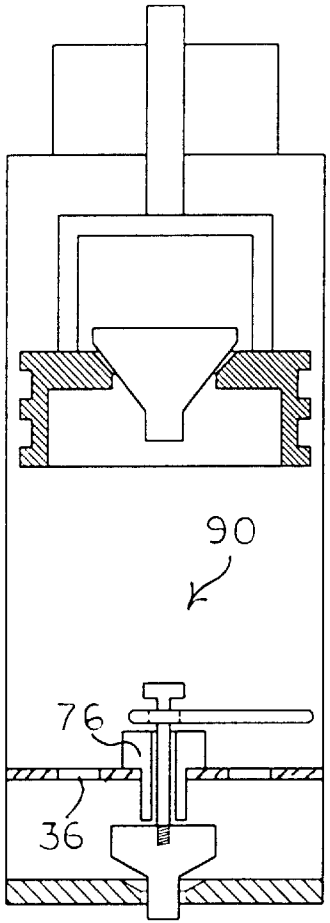
Figure 7A:
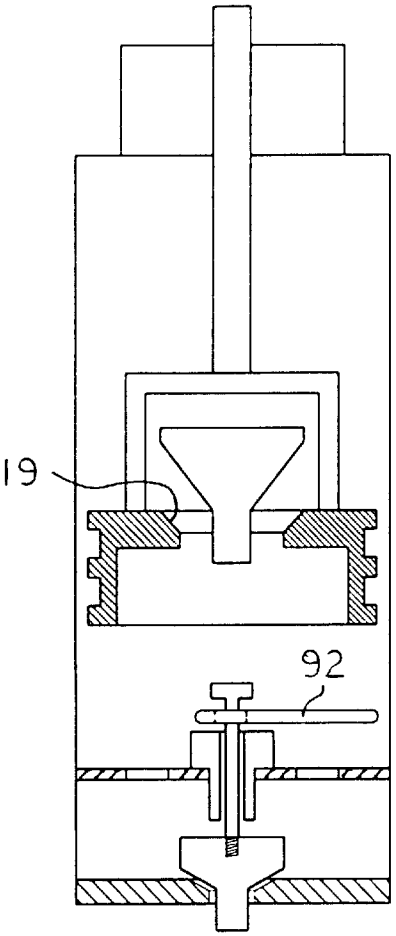

FIGS. 7A, 7B and 7C illustrate a fifth embodiment 90 utilizing a straight, elongated and planar trigger 92 in the fifth standing valve unit 94.

Thus, various configurations of the trigger 62 have been illustrated to function effectively in standing valve units of the present invention.

It is to be understood that the present invention is not limited to the embodiments described above, but encompasses any and all embodiments within the scope of the following claims.

I claim:

1. A relievable check valve assembly for oil wells and water wells comprising:

a standing valve unit comprising a circular disc having a centered throughbore and a plurality of peripheral apertures, a bushing located within said centered throughbore, and a bell-shaped standing valve member having a threaded aperture;

a guide pin having a head and a threaded shaft; and a trigger element having an upturned end with a decreasing width and a throughbore located at an opposite round end adapted for passing said guide pin sequentially through said trigger element, said centered throughbore of the circular disc and the bushing to attach to the bell-shaped standing valve member;

whereby a conventional travelling valve unit travels down to contact and depress said guide pin to elevate the bell-shaped standing valve member for opening up a valve seat to allow any standing liquid to pass down in a down hole.

2. The relievable check valve assembly according to claim 1, wherein the trigger element has an inverted U-shaped cross-sectional configuration with parallel sides extending downward, and wherein the upturned end is flat.

3. The relievable check valve assembly according to claim 1, wherein the trigger element has a linear double curved configuration, wherein the its outer portion is concave upwards and its inner portion is concave downwards with its apex having a throughbore.

4. A relievable check valve assembly for oil wells and water wells comprising:

a standing valve unit comprising a circular disc having a centered throughbore and a plurality of peripheral apertures, a bushing located within said centered throughbore, and a bell-shaped standing valve member having a threaded aperture;

a guide pin having a head and a threaded shaft; and a trigger element having two Y-shaped elements of equal length with its legs connected by a hinge, a throughbore adapted for passing said guide pin sequentially through said trigger element, said centered throughbore of the circular disc and the bushing to attach to the bell-shaped standing valve member;

whereby a conventional travelling valve unit travels down to contact and depress said guide pin to elevate the bell-shaped standing valve member for opening up a valve seat to allow any standing liquid to pass down in a down hole.

* * * * *